United States Patent [19]

Ayers

[11] 4,361,743

[45] Nov. 30, 1982

[54] LOST MOTION KEYSWITCH

[75] Inventor: Robert D. Ayers, Raleigh, N.C.

[73] Assignee: Stackpole Components Company, Raleigh, N.C.

[21] Appl. No.: 241,243

[22] Filed: Mar. 6, 1981

[51] Int. Cl.[3] ..... H01H 13/52; H01H 3/12

[52] U.S. Cl. ..... 200/153 V; 200/159 A; 200/153 M

[58] Field of Search ..... 200/153 V, 153 M, 159 A, 200/159 R, 340

[56] References Cited

U.S. PATENT DOCUMENTS

| | | | |
|---|---|---|---|
| 3,060,285 | 10/1962 | Steinbruner | 200/159 A |
| 3,773,997 | 11/1973 | Evans et al. | 200/153 V |
| 3,902,032 | 8/1975 | Koepke | 200/159 A |

FOREIGN PATENT DOCUMENTS

| | | | |
|---|---|---|---|
| 4610378 | 11/1967 | Japan | 200/159 A |

*Primary Examiner*—John W. Shepperd
*Attorney, Agent, or Firm*—Brown, Flick & Peckham

[57] ABSTRACT

A hollow plunger is slidable vertically in a housing that has an open upper end, but its upward travel is limited to a predetermined elevated position, in which the lower end of the plunger body is spaced above the housing's bottom wall that holds a pair of opposed spring contact strips that extend below it to form terminals and that also converge upwardly inside the plunger and have upper ends urged toward engagement with each other. Loosely disposed inside the plunger is a shuttle provided with a cross member extending between the contact strips. The inside of the plunger is formed for supporting the shuttle while the plunger is held in its elevated position by a coil spring encircling the contact strips with the shuttle cross member spreading the upper ends of the contacts apart. After the plunger has been depressed a predetermined distance, it starts to move the shuttle downwardly with it. The inner side of each contact strip is provided with a projection extending from the point of engagement of the strip by the raised cross member downwardly a predetermined distance to hold the contacts apart until the descending cross member slides off the lower ends of the projections.

4 Claims, 8 Drawing Figures

LOST MOTION KEYSWITCH

The keyswitch disclosed in this application is the type shown in copending patent application, Ser. No. 075,945, filed Sept. 17, 1979, now U.S. Pat. No. 4,255,635 in which two upstanding spring contacts normally are held apart inside a plunger but are permitted to close when the plunger is depressed against the resistance of a return spring. In keyswitches it is desirable to provide switching hysteresis or lost motion to prevent "teasing" of the switch controls. It also is desirable to provide tactile feedback, as the switching action occurs, to meet the psychological needs of the operator. Earlier attempts to provide hysteresis and/or tactile feedback involved mechanisms that were indirectly related to switching action and that were difficult to assemble.

It is among the objects of this invention to provide a keyswitch of the type just mentioned, in which when the plunger is depressed there is lost motion or hysteresis in switching action and in which there is tactile feedback concurrently with switching action.

The preferred embodiment of the invention is illustrated in the accompanying drawings, in which FIG. 1 is a plan view of the switch;

Figure 8:
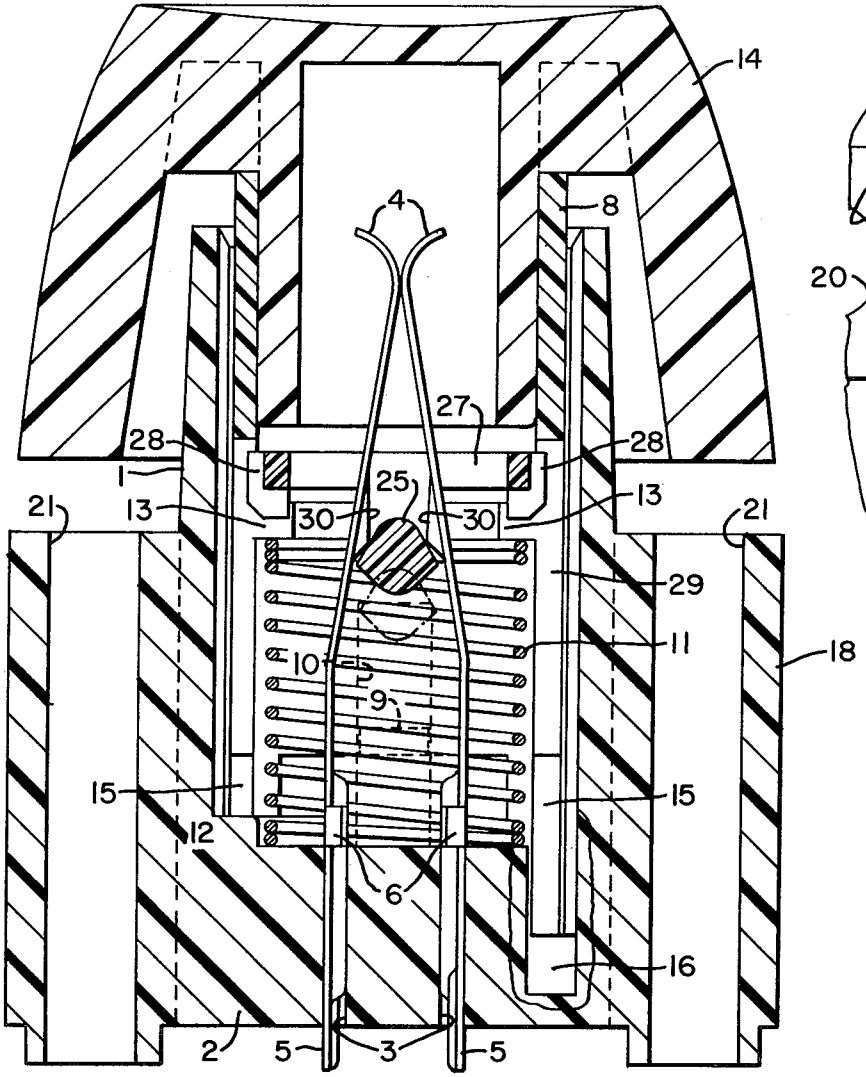
FIG. 8 is a view similar to FIG. 3 but showing the switch just as it closes.

Referring to FIGS. 3 to 6 of the drawings, a rectangular switch housing 1 has an open upper end, and a lower end closed by a relatively thick botton wall 2. The bottom wall is provided with a pair of laterally spaced slots 3 extending substantially vertically therethrough. Fitting tightly in these slots is a pair of spring contact strips 4 that project below the wall to form electric terminals 5 that may be plugged into a printed circuit board. The distance each contact strip can be inserted in the slot is limited by tangs 6 projecting from opposite edges of the strip into engagement with an upper surface of bottom wall 2. The contact strips extend upwardly in the housing with their upper portions inclined toward each other sufficiently to normally come into engagement with each other near their upper ends as shown in FIG. 8. Above their engaging or contact points the two strips are curved away from each other.

Figure 3:
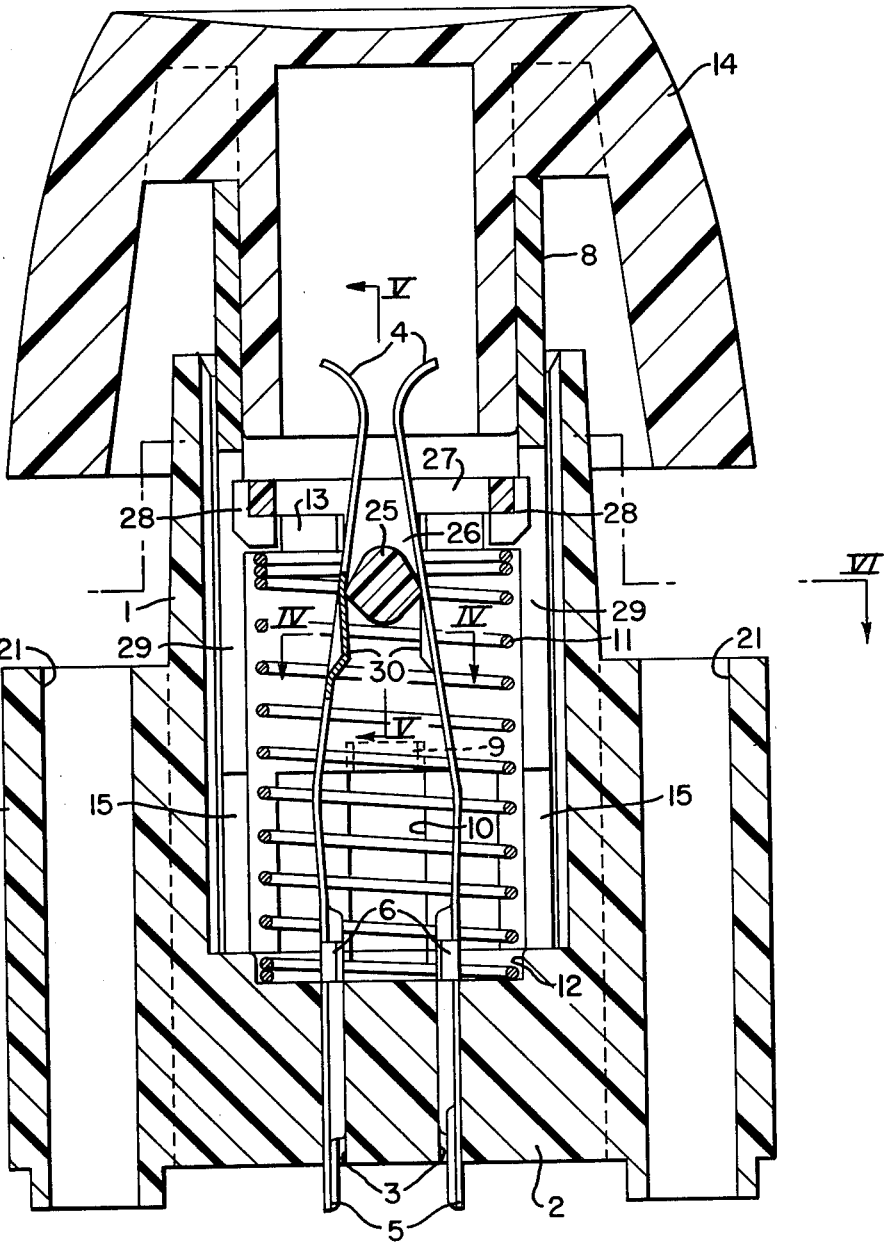
FIG. 3 is an enlarged vertical section showing the switch open.
Figure 6:
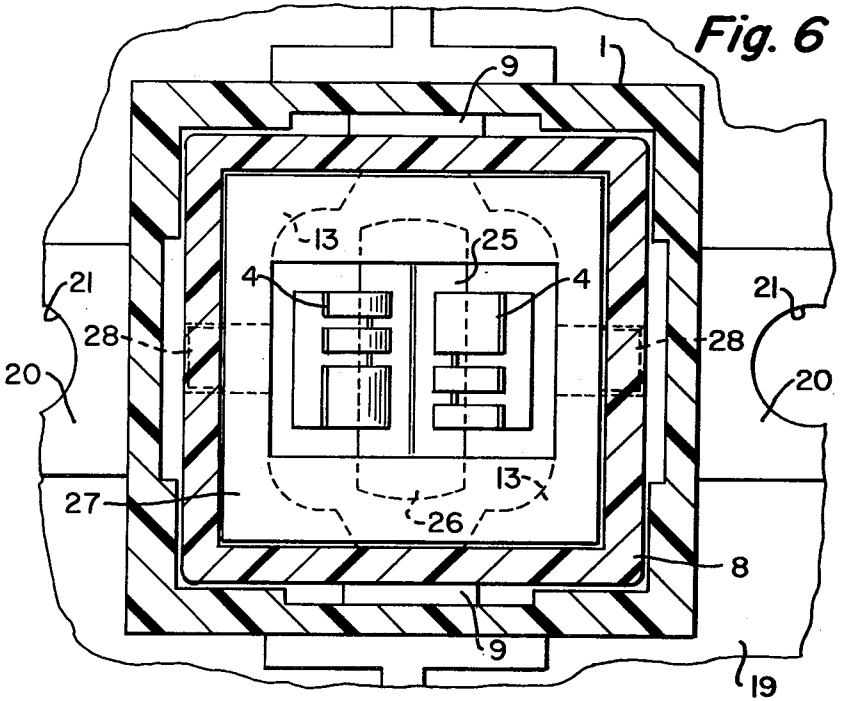
FIG. 6 is a further enlarged cross section taken on the line VI—VI of FIG. 3.
Figure 5:
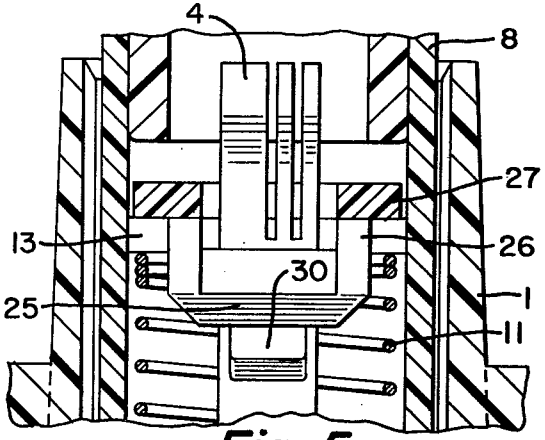
FIG. 5 is a fragmentary vertical section taken on the line V—V of FIG. 3.

Disposed in the switch housing is a tubular plunger that has a rectangular body 8 slidably engaging the housing for movement up and down in it. As indicated in dotted lines in FIG. 3, the lower ends of two opposite sides of the plunger body are provided with outwardly projecting lugs 9. The lower portions of the housing side walls beside these tongues are provided with vertiCaL slots 10, into which the lugs snap when the plunger is inserted in the housing. The purpose of the lugs is to limit upward travel of the plunger in the housing and to lock it in the housing. The plunger normally is held in its upper position, determined by engagement of the lugs with the upper ends of slots 10, by a coil spring 11 seated in a recess 12 in the top of the bottom wall. The spring encircles the contact strips but is spaced from them. The upper end of the spring engages corner ledges 13 on the inside of the plunger. While the plunger is held in its upper position by the coil spring, the lower end of the plunger body is spaced from the bottom wall of the housing as shown in FIG. 3. Mounted on the upper end of the plunger is a keycap 14 for depressing the plunger against the resistance of the coil spring.

In spite of the relatively thick bottom wall of the housing and the resulting relatively short body of the plunger, there is enough length of the plunger engaging the housing when the plunger is in its upper position to prevent wobble of the plunger and keycap. Accordingly, as shown in FIGS. 3 and 8, the plunger body has legs 15 extending downwardly from its four corners for engaging that area of the housing between the plunger body and the bottom of the housing while the plunger is elevated. In other words, the plunger engages the housing for substantially the full length of the inside of the housing while the plunger is raised. To permit the plunger to be depressed, the corners of the bottom wall are provided with downwardly extending sockets 16 for receiving the plunger legs 15. One of the sockets is shown in FIG. 8. Preferably, each leg has two sides at right angles to each other for engaging two adjoining sides of the housing, and each socket has flat sides forming continuations of the housing sides above it.

To facilitate mounting the switch in place, it is preferred to surround the lower portion of the housing by an outer wall 18 that has a thin bottom wall 19 (FIG. 6) connected with the thick bottom wall of the housing. Suitable vertical ribs connect this outer wall with the side walls of the housing. Ribs 20 are provided with vertical passages 21 for receiving screws to hold the housing on a printed circuit board. A snap-in type of mounting can be used if the keyswitch is to be mounted on a panel.

Except for the spring and the contact strips, all of this keyswitch preferably is formed from molded plastic.

It is a feature of this invention that while the plunger is in its upper position shown in FIG. 3 the two contact strips are held apart by a cross bar 25 between them that is connected at its ends to legs 26 extending downwardly from opposite sides of a rectangular frame 27 slidably disposed in the hollow plunger above corner ledges 13. The frame, legs and cross bar form a shuttle. At two opposite sides of the frame it is provided with bosses 28 projecting outwardly into vertical slots 29 in the adjoining sides of the plunger. The shuttle normally rests on the corner ledges, with the upper ends of slots 29 spaced a short distance above bosses 28 as shown in FIG. 3. Consequently, the plunger is movable downwardly until the upper ends of its slots engage the shuttle, without moving the shuttle. This is the lost motion that is built into the switch. The shuttle can be inserted in the plunger from its upper end since the thin sides of the plunger are flexible enough to permit the shuttle bosses to be pushed down in the plunger until they snap out into slots 29.

Figure 1:
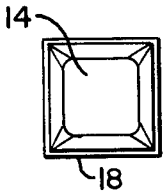
Figure 2:
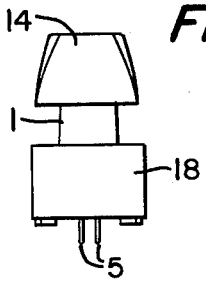
FIG. 2 is a side view.
Figure 4:
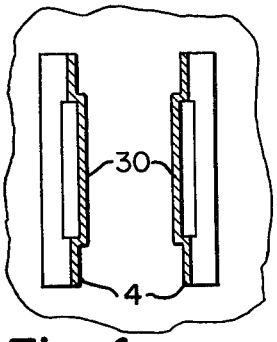
FIG. 4 is a cross section of the contact strips taken on the line IV—IV of FIG. 3.

The lower portion of cross bar 25 is tapered downwardly so that as the plunger and cross bar are being assembled with the switch housing the cross bar will easily slide down between the curved upper end of the contact strips as it spreads them apart. The upper portion of the cross bar is tapered upwardly from the lower portion, thereby providing line contact with each of the contact strips. In the upper position of the plunger and cross bar, the latter holds the contact strips out of engagement with each other by engaging them at the upper ends of projections 30 at the inner sides of the strips. These projections extend down the strip a predetermined distance, with the bar-contacting surfaces of the projections substantially flat and preferably converging downwardly slightly to a point near their lower ends, at which point the surfaces of the projections diverge sharply. Projections 30 can be formed by pressing them out of the contact strips, as shown in FIGS. 3 and 4.

Figure 7:
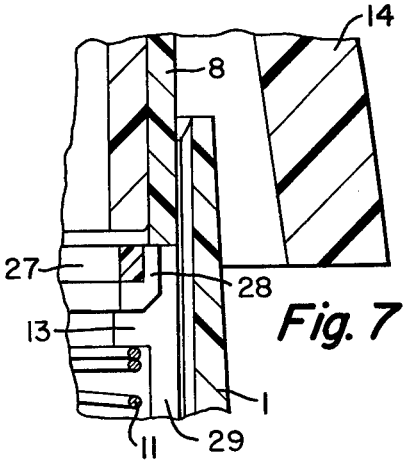
FIG. 7 is a fragmentary vertical section showing the lost motion taken up.

When the keycap is pressed down to close the switch, the plunger will move down without moving the shuttle until the upper ends of the plunger slots 29 engage the shuttle bosses 28, as shown in FIG. 7. Continued downward movement of the plunger then will move the shuttle down with it, which will cause cross bar 25 to slide down the projections 30 on the contact strips. Since the opposed surfaces of the projections are nearly vertical for most of their length, the cross bar will not allow the contacts to engage each other until the bar reaches the diverging lower ends of the projections. At that moment the shuttle moves downward toward ledges 13 and the contacts are permitted to spring together as shown in FIG. 8. Since the available travel of the shuttle relative to the plunger is greater than that required to permit contact closure, the shuttle comes to rest against ledges 13 with its cross bar at a point below, and out of engagement with, the projections 30. It can be seen that in order to open the switch, the plunger must be allowed to travel upward some distance before cross bar 25 can engage projections 30 and separate the contacts. Thus, the lost motion of the shuttle provides switch operating hysteresis. As the plunger continues its downward movement to its lower limit, the cross bar will be in the position shown in dotted lines in FIG. 8.

It will be seen that there is lost motion of the keycap and plunger before the contacts close. The moment that the cross bar permits the closing, the operator can feel the cross bar leaving the strip projections 30, thereby getting tactile feedback. At the same moment he can hear the contacts click together if the surroundings are quiet, whereby he can obtain both tactile and audible feedback.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A lost motion keyswitch comprising a housing having a bottom wall and an open upper end, a plunger having a tubular body extending downwardly in the housing and slidably engaging said housing for movement up and down therein, means limiting upward travel of the plunger to a predetermined elevated position, the lower end of said plunger body being spaced above said bottom wall while the plunger is in said elevated position, a pair of opposed spring contact strips extending through said bottom wall and projecting below it to form terminals, the contact strips also converging upwardly inside the plunger and having upper ends urged toward engagement with each other, a shuttle loosely disposed inside the plunger body and provided with a cross member extending between the contact strips, the inside of the plunger being provided with means for supporting the shuttle while the plunger is in said elevated position, and a coil spring inside the plunger below said shuttle-supporting means and encircling the contact strips but spaced therefrom, said spring normally holding the plunger in said elevated position with said cross member spreading the upper ends of the contacts apart, the plunger being provided with means normally spaced above the shuttle for moving the shuttle downwardly after the plunger has been depressed a predetermined distance, and the inner side of each contact strip being provided with a projection extending substantially from the point of engagement of the strip by the raised cross member downwardly a predetermined distance to hold the contacts apart until the descending cross member slides off the lower ends of said projections.

2. A lost motion keyswitch according to claim 1, in which said shuttle-supporting means is ledge means integral with the plunger, and said coil spring is compressed between said ledge means and said housing bottom wall.

3. A lost motion keyswitch according to claim 1, in which said plunger is provided with oppositely disposed vertical slots, said shuttle is provided with bosses projecting laterally into said slots, the slots normally extend above said bosses, and the upper end walls of the slots serve as said means for moving the shuttle downwardly.

4. A lost motion keyswitch according to claim 1, in which said contact strip projections converge downwardly slightly and then diverge at their lower ends.

* * * * *